US007712399B2

(12) United States Patent
Nenadic

(10) Patent No.: US 7,712,399 B2
(45) Date of Patent: May 11, 2010

(54) TOOL AND ASSOCIATED BIT DRIVER

(75) Inventor: John P. Nenadic, Camas, WA (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

(21) Appl. No.: 11/868,175

(22) Filed: Oct. 5, 2007

(65) Prior Publication Data

US 2009/0090225 A1 Apr. 9, 2009

(51) Int. Cl.
*B25B 23/16* (2006.01)
*B25B 15/00* (2006.01)
*B25B 7/22* (2006.01)

(52) U.S. Cl. ..... 81/427.5; 81/438; 7/128; 7/165

(58) Field of Classification Search ..... 81/427.5, 81/438, 439, 177.85, 177.2, 440; 7/128, 7/167, 118, 165
See application file for complete search history.

(56) References Cited

U.S. PATENT DOCUMENTS

| | | | | |
|---|---|---|---|---|
| 18,206 | A | 9/1857 | Lamson | |
| 187,483 | A | 2/1877 | Rightor | |
| 345,296 | A | 7/1886 | Friebertshauser | |
| 364,414 | A | 6/1887 | Hollweg | |
| 610,530 | A | 9/1898 | Hammesfahr | |
| 730,509 | A * | 6/1903 | Baker | 403/4 |
| 825,093 | A | 7/1906 | Watson | |
| 1,179,111 | A | 4/1916 | Knowlton | |
| 1,370,820 | A * | 3/1921 | Oscoe | 81/114 |
| 1,800,843 | A | 4/1931 | Moulton | |
| 2,250,290 | A | 7/1941 | Berg | |
| 2,263,415 | A | 11/1941 | Berg et al. | |
| 2,597,540 | A | 5/1952 | Smith | |
| 2,682,414 | A * | 6/1954 | Richardson | 279/77 |
| 2,718,695 | A | 9/1955 | Elsener | |
| 2,809,384 | A | 10/1957 | Kayser | |
| 3,363,315 | A | 1/1968 | Anderson | |
| 3,832,775 | A | 9/1974 | Stahel, II et al. | |
| 4,187,607 | A | 2/1980 | Simuro et al. | |

(Continued)

FOREIGN PATENT DOCUMENTS

| | | |
|---|---|---|
| EP | 0 771 622 A1 | 5/1997 |

(Continued)

OTHER PUBLICATIONS

European Search Report for European Patent Application No. 08100265.1; Date of Completion May 9, 2008.

(Continued)

*Primary Examiner*—David B Thomas
(74) *Attorney, Agent, or Firm*—Alston & Bird LLP

(57) ABSTRACT

A tool and an associated bit driver are provided. The tool includes a handle and a bit driver carried by the handle. The bit driver can include a body defining a cavity for receiving a bit and a pivotable lock configured to move between a locked position in which the lock engages the bit and an unlocked position in which the lock is spaced and thereby disengaged from the bit. The pivotable lock can include a pivot pin, an engagement member for engaging the bit and an actuation member with the engagement and actuation members extending along the body in opposite directions from the pivot pin.

22 Claims, 14 Drawing Sheets

U.S. PATENT DOCUMENTS

| | | | | | |
|---|---|---|---|---|---|
| 4,238,862 | A | | 12/1980 | Leatherman | |
| 4,328,721 | A | * | 5/1982 | Massari | 81/439 |
| 4,512,051 | A | | 4/1985 | Magan | |
| 4,563,813 | A | | 1/1986 | Fortenberry | |
| 4,570,341 | A | | 2/1986 | Konneker | |
| 4,744,272 | A | | 5/1988 | Leatherman | |
| 4,759,645 | A | | 7/1988 | Kuo | |
| 4,776,094 | A | | 10/1988 | Glesser | |
| 4,805,303 | A | | 2/1989 | Gibbs | |
| 4,888,869 | A | | 12/1989 | Leatherman | |
| 4,934,717 | A | * | 6/1990 | Budelman et al. | 279/79 |
| 5,142,721 | A | | 9/1992 | Sessions et al. | |
| 5,251,353 | A | | 10/1993 | Lin | |
| 5,267,366 | A | | 12/1993 | Frazer | |
| 5,270,909 | A | | 12/1993 | Weiss et al. | |
| 5,349,753 | A | | 9/1994 | Gaffney | |
| 5,361,655 | A | * | 11/1994 | Fowlkes | 81/177.2 |
| 5,450,670 | A | | 9/1995 | Sakai | |
| 5,463,798 | A | | 11/1995 | Wurzer | |
| 5,511,310 | A | | 4/1996 | Sessions et al. | |
| 5,537,750 | A | | 7/1996 | Seber et al. | |
| 5,581,834 | A | * | 12/1996 | Collins | 7/118 |
| 5,628,117 | A | | 5/1997 | Glesser | |
| 5,653,525 | A | | 8/1997 | Park | |
| 5,697,114 | A | | 12/1997 | McIntosh et al. | |
| 5,745,997 | A | | 5/1998 | Berg et al. | |
| 5,765,247 | A | | 6/1998 | Seber et al. | |
| 5,822,867 | A | | 10/1998 | Sakai | |
| D405,676 | S | | 2/1999 | Rivera | |
| 5,931,065 | A | * | 8/1999 | Jackson et al. | 81/177.2 |
| 5,983,686 | A | | 11/1999 | Lee | |
| 6,006,385 | A | | 12/1999 | Kershaw et al. | |
| 6,014,787 | A | | 1/2000 | Rivera | |
| 6,023,805 | A | | 2/2000 | Lin | |
| 6,029,549 | A | * | 2/2000 | Baker | 81/439 |
| 6,038,735 | A | | 3/2000 | Chang | |
| 6,038,946 | A | * | 3/2000 | Jackson et al. | 81/177.2 |
| 6,058,814 | A | * | 5/2000 | Johnson | 81/177.2 |
| 6,112,352 | A | | 9/2000 | Legg | |
| 6,223,372 | B1 | | 5/2001 | Barber | |
| 6,286,397 | B1 | | 9/2001 | Taggart et al. | |
| 6,341,423 | B1 | | 1/2002 | Taggart et al. | |
| 6,370,990 | B1 | * | 4/2002 | Lin | 81/177.2 |
| 6,470,522 | B2 | | 10/2002 | Veltz et al. | |
| D474,095 | S | | 5/2003 | Luquire | |
| 6,594,906 | B1 | | 7/2003 | Sakai et al. | |
| 6,622,327 | B1 | | 9/2003 | Rivera | |
| 6,622,328 | B2 | | 9/2003 | Rivera | |
| D484,770 | S | | 1/2004 | Green | |
| 6,971,290 | B1 | * | 12/2005 | Ybarra | 81/177.2 |
| 7,000,323 | B1 | | 2/2006 | Hatcher et al. | |
| 7,126,484 | B1 | | 10/2006 | Luquire | |
| D538,138 | S | | 3/2007 | Knight | |
| 7,185,569 | B2 | | 3/2007 | Knight et al. | |
| 2005/0045002 | A1 | * | 3/2005 | Cluthe | 81/177.85 |
| 2005/0144730 | A1 | | 7/2005 | Barber et al. | |
| 2006/0277762 | A1 | | 12/2006 | Knight et al. | |

FOREIGN PATENT DOCUMENTS

| | | | |
|---|---|---|---|
| EP | 0 783 937 | A2 | 7/1997 |
| EP | 1 023 971 | A2 | 8/2000 |
| EP | 1 116 557 | A2 | 7/2001 |
| EP | 1 223 011 | A2 | 7/2002 |
| EP | 1 340 597 | A2 | 9/2003 |
| FR | 2 655 635 | A1 | 6/1991 |
| FR | 2 760 955 | A1 | 9/1998 |
| WO | WO 97/19787 | A1 | 6/1997 |
| WO | WO 98/18599 | A1 | 5/1998 |

OTHER PUBLICATIONS

Van Hoy Snap Lock, available at http://www.crkt.com/snaplock.html (Jul. 5, 2006), 2 pages.

Delta Folding Knife—EW-04 available from SureFire, available at http://www.surefire.com/maxexp/main/co__disp/displ/carfnbr/317/prrfnbr/24381 (Jul. 5, 2006), 1 page.

Cord/Harness Cutter, available at http://www.surefire.com/surefire/content/ew04_large.jpg, (Jul. 5, 2006), 1 page.

Swiss+Tech Products, available at http://www.swisstechtools.com/productdetail.aspx?PID=pHL7RxHb%2frwA, (Jul. 5, 2006), 1 page.

Serengeti Hunter, available at http://www.crkt.com/serenget.html, (Jul. 5, 2006), 2 pages.

* cited by examiner

TOOL AND ASSOCIATED BIT DRIVER

FIELD OF THE INVENTION

Embodiments of the present invention relate generally to a tool and, more particularly, to a tool having a bit driver that is configured in one position to securely engage and hold a bit and in another position to release the bit, such that the bit can be readily removed from the bit driver.

BACKGROUND OF THE INVENTION

Tools, such as multipurpose tools are widely popular for their utility in a substantial number of different applications. As its name suggests, a multipurpose tool includes a number of tools carried by common frame. A multipurpose tool may include different combinations of tools depending upon its intended application. For example, multipurpose tools that are designed for a more universal or generic application can include pliers, a wire cutter, a bit driver, one or more knife blades, a saw blade, a bottle opener or the like. Other multipurpose tools are designed to service more specific applications or niche markets and correspondingly include tools that are useful for the intended application. For example, multipurpose tools may be specifically designed for automobile repairs, hunting, fishing or other outdoor applications, gardening, military applications and the like.

As multipurpose tools are frequently carried by users in the field it is desirable for the multipurpose tools to be relatively small and lightweight while remaining rugged so as to resist damage. In order to reduce the overall size of a multipurpose tool, some multipurpose tools have been designed to be foldable. In this regard, foldable multipurpose tools are designed to move between a closed position and an open position. Generally, the closed position is more compact with the multipurpose tool frequently being carried in the closed position. Conversely, while the open position is generally less compact than the closed position, the open position generally allows the deployment of one or more of the tools that are stowed and relatively inaccessible when the multipurpose tool is in the closed position.

For example, a multipurpose tool may include pliers having a pair of jaws connected to respective handles. In the open position, the pliers are deployed and capable of being actuated by movement of the handles toward and away from one another. In the closed position, the handles may be folded about the pliers such that the pliers are no longer functional. In the closed position, however, the multipurpose tool is more compact with the form factor generally defined by the proximal relationship of the handles.

One reason for the popularity of multipurpose tools is the capability provided by a multipurpose tool to provide a wide range of functionality with a single tool, thereby reducing the need to carry a number of different tools to perform those same functions. For example, a single multipurpose tool may be carried instead of a pair of pliers, one or more screwdrivers, a knife and a bottle opener. As such, the burden upon a user is reduced since the user need only carry a single multipurpose tool.

As noted above, one common tool of a multipurpose tool is a bit driver. A bit driver is advantageously designed to receive a variety of different bits in order to increase the functionality of the multipurpose tool. Bit drivers may frictionally engage a bit so as to secure the bit within the bit driver during use. In order to remove the bit, such as in instances in which the user desires to utilize a different bit, the user can pull the bit from the bit driver, thereby overcoming the frictional force that otherwise retains the bit within the bit driver. At least some bit drivers have included a spring member to frictionally engage the bit. For example, one conventional bit driver includes a spring disposed in a sidewall of the bit driver and having an inwardly turned portion for engaging a bit and for securing the bit within the bit driver during use. In order to remove the bit, a user could pull the bit from the bit driver by applying a force sufficient to overcome the force applied by the spring and to cause the spring to flex outwardly by the amount necessary to permit the bit to be removed.

While conventional bit drivers have been serviceable, it would be desirable to design a bit driver that more securely retains the bit within the bit driver, such as during use of the bit. Moreover, it would be desirable to design a bit driver that could be selectably actuated in order more readily release the bit to facilitate the removal and insertion of bits.

BRIEF SUMMARY OF THE INVENTION

According to one aspect of the present invention, a bit driver is provided that includes a body defining a cavity for receiving at least the portion of a bit, and a pivotable lock for selectably engaging the bit. As such, the bit driver can securely retain the bit, such as during use of the bit. However, the bit driver, and, in particular, the pivotable lock, can be selectably actuated in order to release the bit in order to facilitate the removal of the bit and the insertion of another bit. According to another aspect of the present invention, a tool is provided that includes a handle and a bit driver carried by the handle.

According to one embodiment, a bit driver is provided that includes a body and a pivotable lock disposed proximate the body and configured to move between a locked position in which the pivotable lock engages the bit and an unlocked position in which the lock is spaced and thereby disengaged from the bit. A tool is also provided according to another embodiment that includes not only the bit driver, but also a handle that carries the bit driver. In this embodiment, the handle can include a spring member for biasing the pivotable lock toward the locked position. For example, the spring member can include a cantilever spring extending lengthwise along the handle. In this embodiment, the body of the bit driver may define a recess for receiving at least the portion of the spring.

According to another embodiment, the bit driver can include a body defining a cavity for receiving at least a portion of a bit, and a pivotable lock that includes a pivot pin, an engagement member for engaging the bit and an actuation member. In this embodiment, the engagement and actuation members extend along the body in opposite directions from the pivot pin. The engagement member can include a tang for engaging the bit in the locked position. In this embodiment, the pivot pin can extend outwardly in opposite directions beyond the body, such as to engage the handle of a tool. A body of the bit driver can also define a groove for receiving the pivot pin.

In use, the spring member of the handle may bias the pivotable lock such that the engagement member engages the bit, thereby securely retaining the bit within the bit driver. In order to remove the bit, however, a user can depress or otherwise actuate the actuation member in order to disengage the engagement member from the bit, thereby permitting the bit to be readily removed from the bit driver and, if desired, another bit to be inserted into the bit driver. Upon releasing the actuation member, the spring member of the handle again causes the engagement member to engage the bit such that the newly inserted bit is securely engaged by the bit driver.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
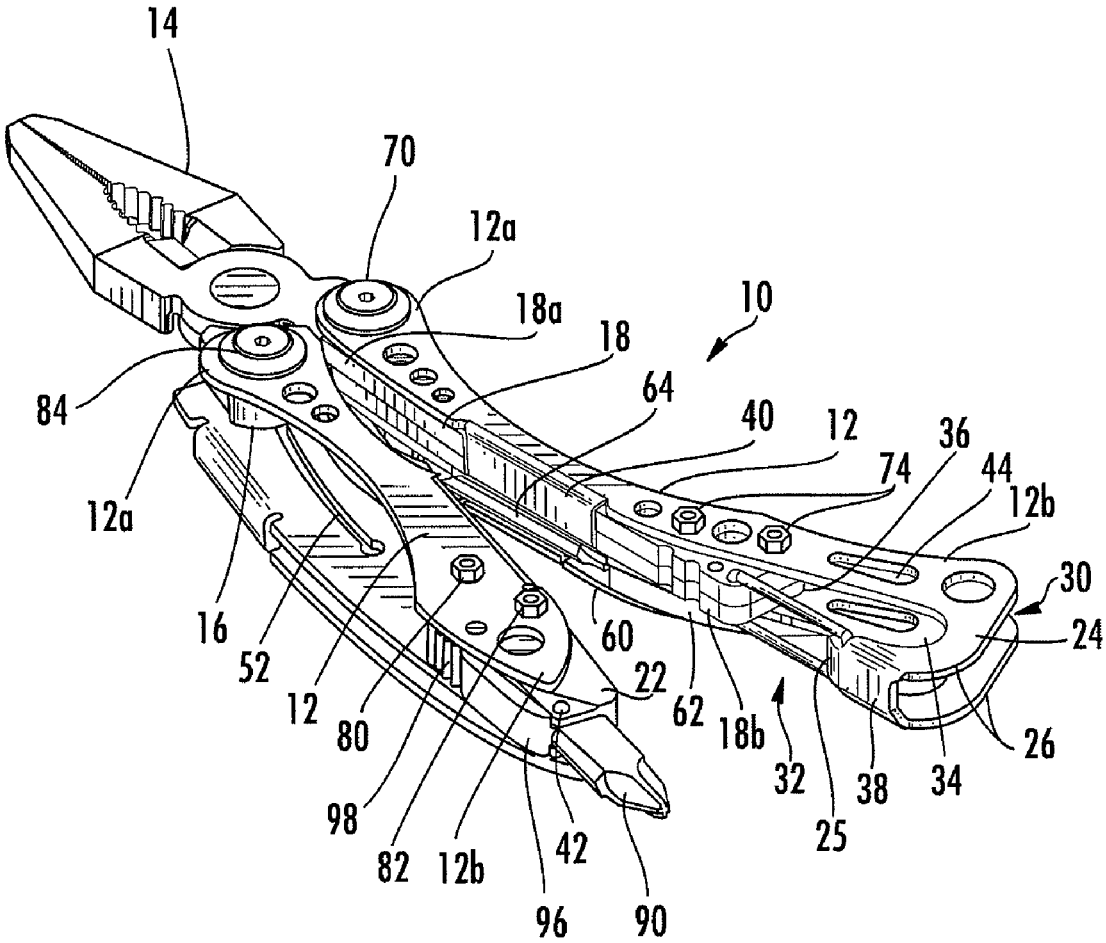
FIG. 1 is a perspective view of a multipurpose tool according to an embodiment of the present invention in the open position.
Figure 2:
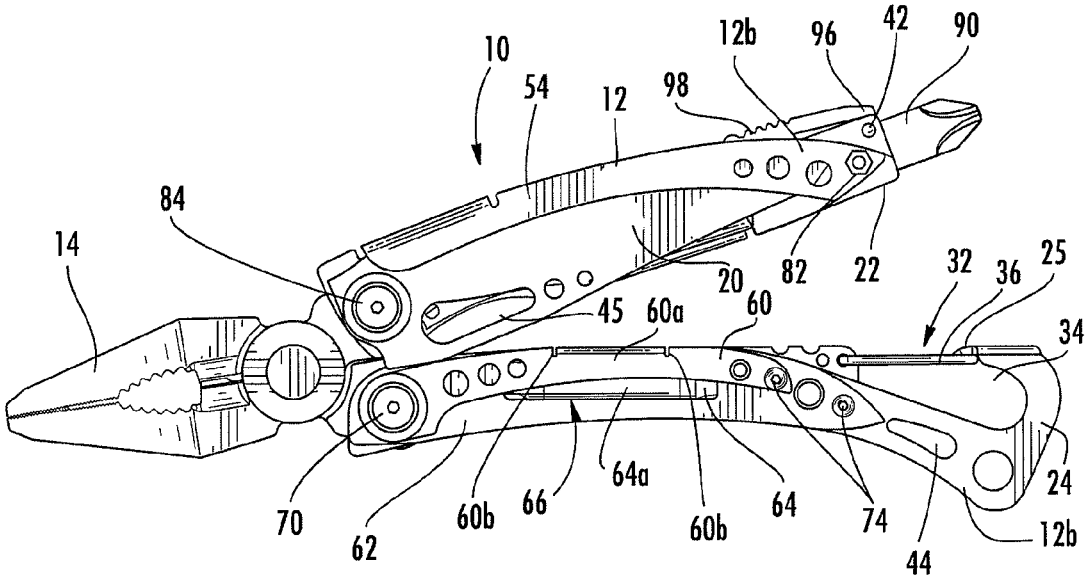
FIG. 2 is a view of a first side of the multipurpose tool of FIG. 1.
Figure 3:
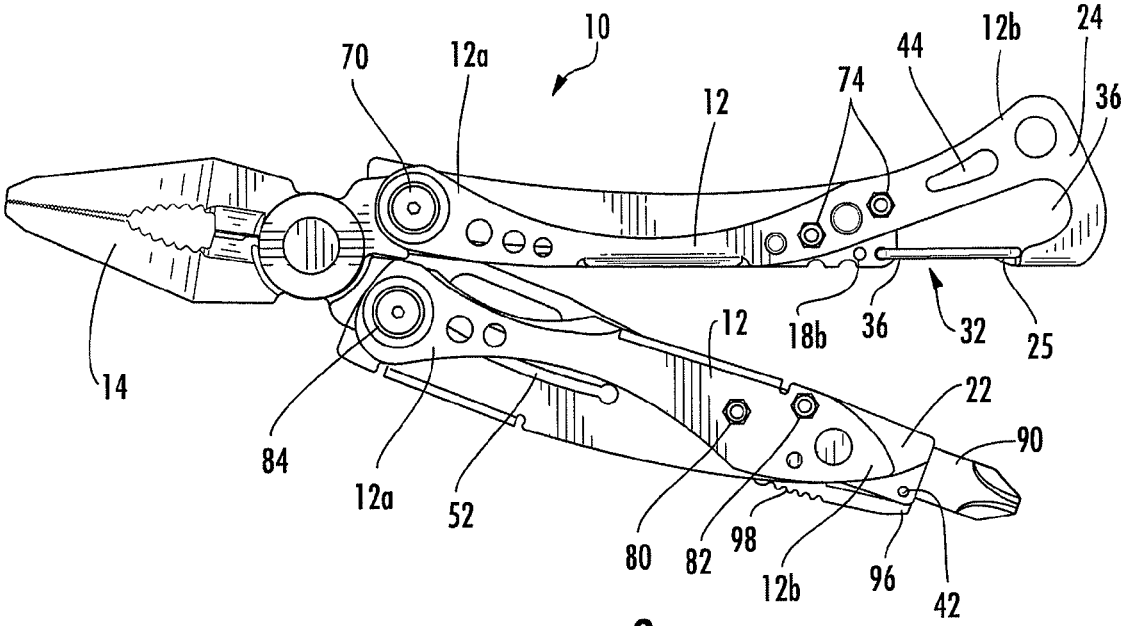
FIG. 3 is a view of a second side of the multipurpose tool of FIG. 1, opposite the first side shown in FIG. 2.

A tool and a bit driver are provided according to embodiments of the present invention. While the tool may be any of a variety of different types of tools, one embodiment of the tool will be described in the context of a multipurpose tool. Referring to FIGS. 1-3, for example, a multipurpose tool 10 according to one embodiment of the present invention is depicted. The multipurpose tool includes a plurality of handles 12 configured for movement relative to one another, as well a plurality of tools carried by at least one of the handles. Typically, the multipurpose tool includes a pair of generally elongate handles that extend between opposed ends 12*a*, 12*b*. As a result of their connection, such a pivotal connection, to one another and/or to one or more of the tools, the handles can be moved toward and away from one another, such as in order to actuate a tool as described below.

Figure 4:
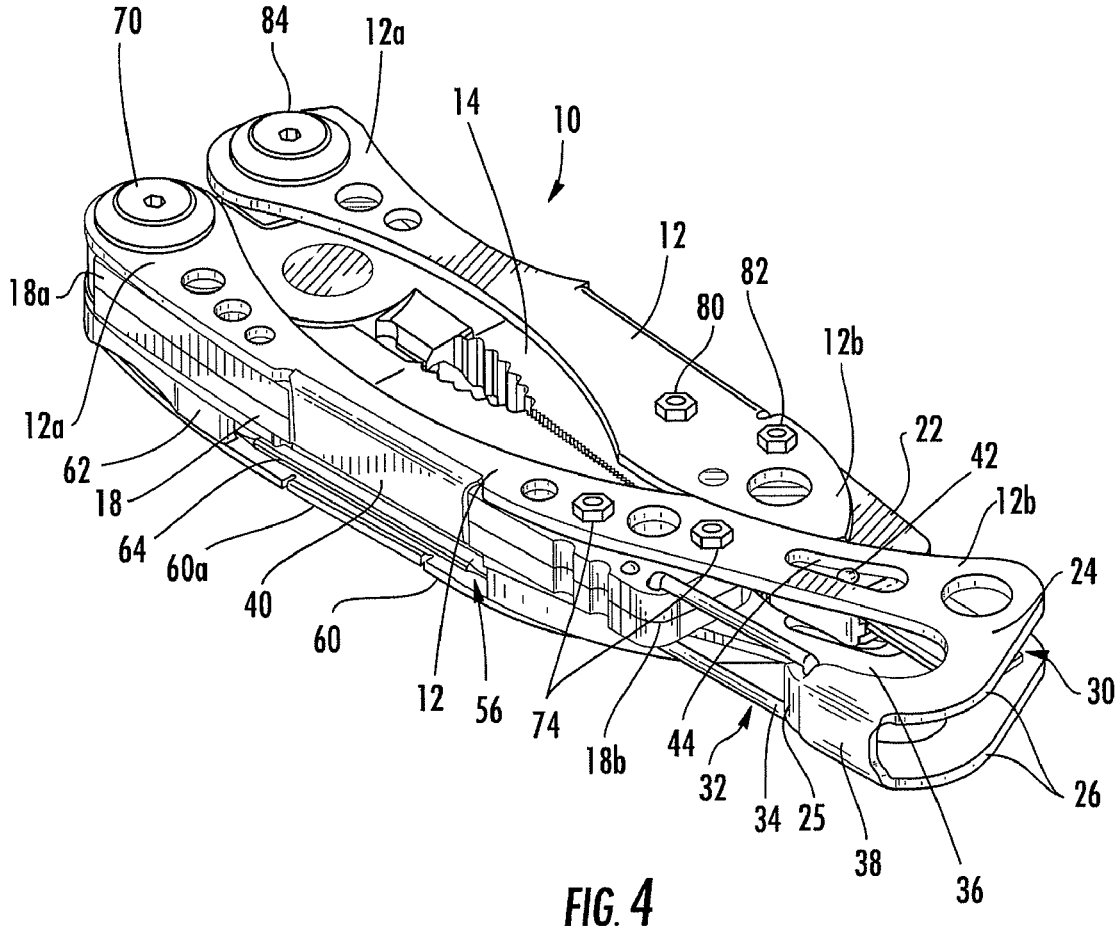
FIG. 4 is a perspective view of the multipurpose tool of FIG. 1 in the closed position.
Figure 5:
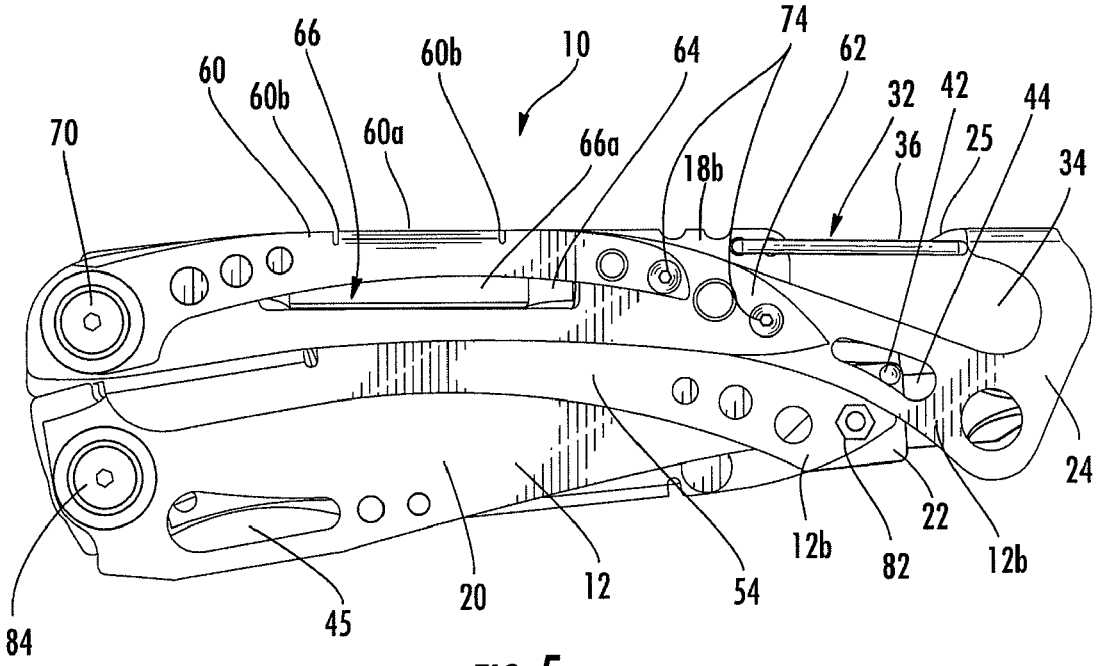
FIG. 5 is a view of a first side of the multipurpose tool of FIG. 4.
Figure 6:
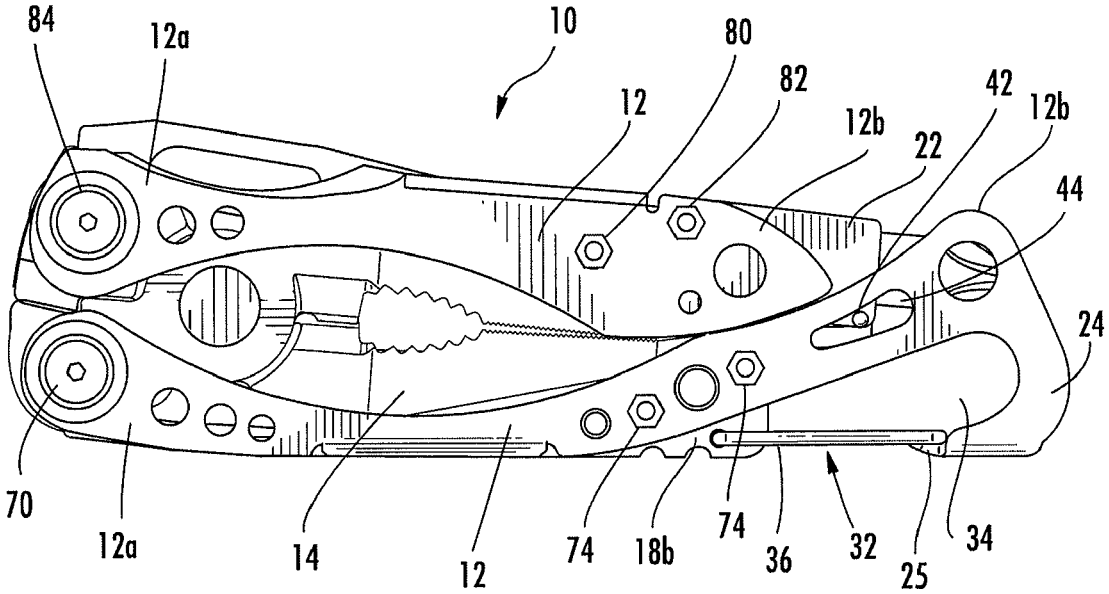
FIG. 6 is a view of a second side of the multipurpose tool of FIG. 4, opposite the first side shown in FIG. 5.

As also described below, the multipurpose tool 10 may be configured such that the handles 12 are adapted for relative movement between an open position as shown in FIGS. 1-3 and a closed position as shown in FIGS. 4-6 and discussed hereinafter. As will be apparent, the multipurpose tool has a compact form factor in the closed position so as to facilitate transport and storage of the multipurpose tool. While the multipurpose tool is more expansive in the open position, one or more of the tools of the multipurpose tool are accessible and capable of being utilized in the open position, even though those same tool(s) are stowed and generally inaccessible in the closed position.

With reference to FIGS. 1-3, a multipurpose tool 10 of one embodiment may include first and second handles 12 that are connected to the opposed jaws of a tool 14 having pivotable jaws, such as the pliers of the illustrated embodiment. In the open configuration, the handles may be moved toward one another to a position shown in FIG. 1 in order to close the jaws of the pliers and away from one another in order to open the jaws of the pliers. In one embodiment, the jaws of the pliers are configured to contact one another once the jaws are in a fully opened position in order to prevent further opening of the jaws.

Even though the jaws cannot be opened any further, the handles 12 can be pivoted relative to the respective jaws in order to transition from the open position as shown in FIG. 1 to the closed position as shown in FIG. 4. Although the handles may be connected to the jaws in a variety of different manners, the pivotable connection between the handles and jaws may incorporate a camming mechanism in order to bias the handles to remaining in either the open or closed positions. For example, those portions of the jaws that are pivotally connected to the handles may serve as eccentric cams 16 and the handles may include one or more corresponding spring members 18 that ride upon the cams. In one embodiment, each handle may include a pair of spring members for cooperating with the cam to resist the pivotal movement of the handle relative to the respective jaw that is required to initiate the transition from the open position to the closed position or, conversely, from the closed position to the open position without the application of additional force. In the embodiment depicted in FIG. 1, for example, the spring members extend lengthwise along the respective handle and engage the cam of the respective jaw at one end 12*a* of the respective handle. In order to transition the multipurpose tool 10 from the open position to the closed position, force would initially be applied to the handles to move the handles further away from one another until the jaws are fully opened. Then, with the application of an additional and larger force in a direction intended to move the opposite ends 12*b* of the handles further away from one another, the resistance provided by the combination of the cams and the spring members can be overcome with the ends 18*a* of the spring members that are proximate the cams being deflected by the cams relative to the remainder of the handle in order to permit pivotal movement of the handles relative to the jaws.

As will be observed, the cams 16 and the spring members 18 can also be configured to provide a comparable force opposing movement of the multipurpose tool 10 from a closed position to the open position that can be similarly overcome by the application of additional force so as to pivot the handles relative to the jaws. The camming mechanism incorporated into the pivotable connection between the handles 12 and the jaws thereby reduces the unlikelihood that the multipurpose tool will be inadvertently transitioned between the open and closed positions.

The multipurpose tool 10 can include a variety of tools. For example, the multipurpose tool can include a tool 14 having pivotable jaws, such as the pliers described above. Although not heretofore described, the pliers can also include wire cutters and/or wire strippers, if desired. Additionally, the multipurpose tool of the embodiment depicted in FIGS. 1-3 includes a knife blade 20 and a bit driver 22 carried by one of the handles 12. Other embodiments of the multipurpose tool can include these tools and/or other tools, such as a saw blade, bottle opener, can opener, saw, file, razor, gut hook or the like. With reference to the illustrated embodiment, the knife blade can be pivotally connected to one of the handles so as to be unfolded to a deployed position, particularly in instances in which the multipurpose tool is in the closed configuration.

Figure 7:
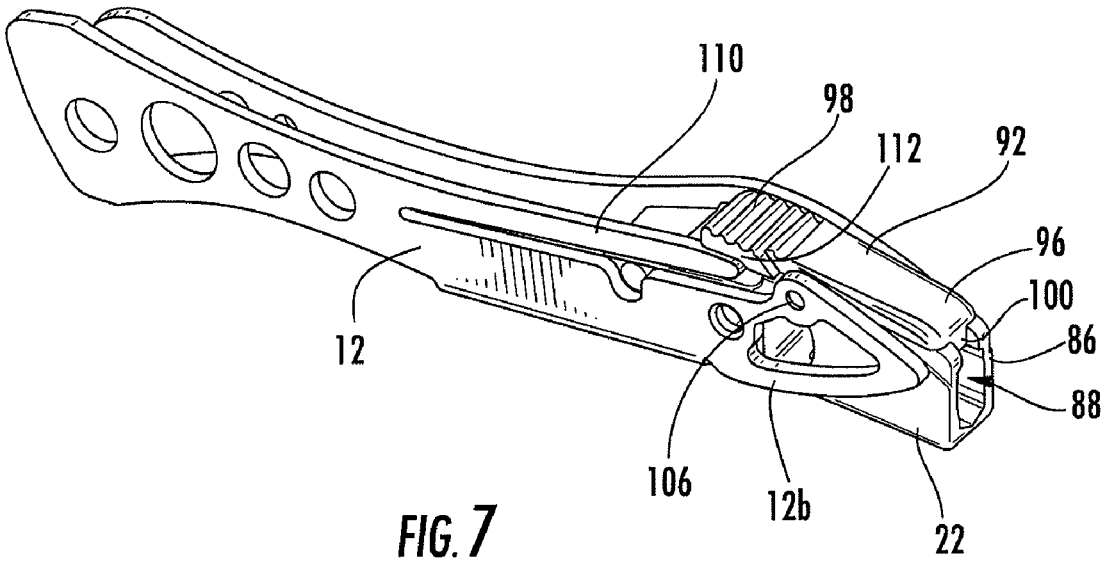
FIG. 7 is a perspective view of a bit driver and a handle that carries the bit driver according to an embodiment of the present invention.

As shown FIG. 7, the bit driver 22 may be carried by one of the handles 12. For example, the bit driver may be carried by one end 12*b* of a handle, such as the end of the handle opposite the pivotable connection with the jaw. In this regard, FIG. 7 only depicts a portion of one of the handles as well as the bit driver in order to more clearly illustrate these components. The bit driver may be secured to the handle, such as by means of one or more fasteners 80, 82 as shown in FIGS. 1, 3, 4 and 6. The bit driver includes a body 86 that defines a cavity 88 that is sized and shaped to snugly receive at least a portion of a corresponding bit 90. The bit driver may receive a wide variety of bits including screwdriver bits, torx bits, hex bits, Robertson bits, etc. As shown in FIG. 7 as well as the exploded perspective view of FIG. 8, the bit driver also includes a pivotable lock 92. The pivotable lock is configured to be moved between a locked position as shown in FIG. 9*a* in which the lock engages a bit disposed within the bit driver and an unlocked position that is shown in FIG. 9*b* in which the lock is spaced and thereby disengaged from the bit. As such, the locked position of the pivotable lock securely engages a bit, such as in instances in which the bit is in use. Conversely, the unlocked position of the pivotable lock permits the bit to be readily withdrawn and another bit inserted into the bit driver, if desired.

Figure 8:
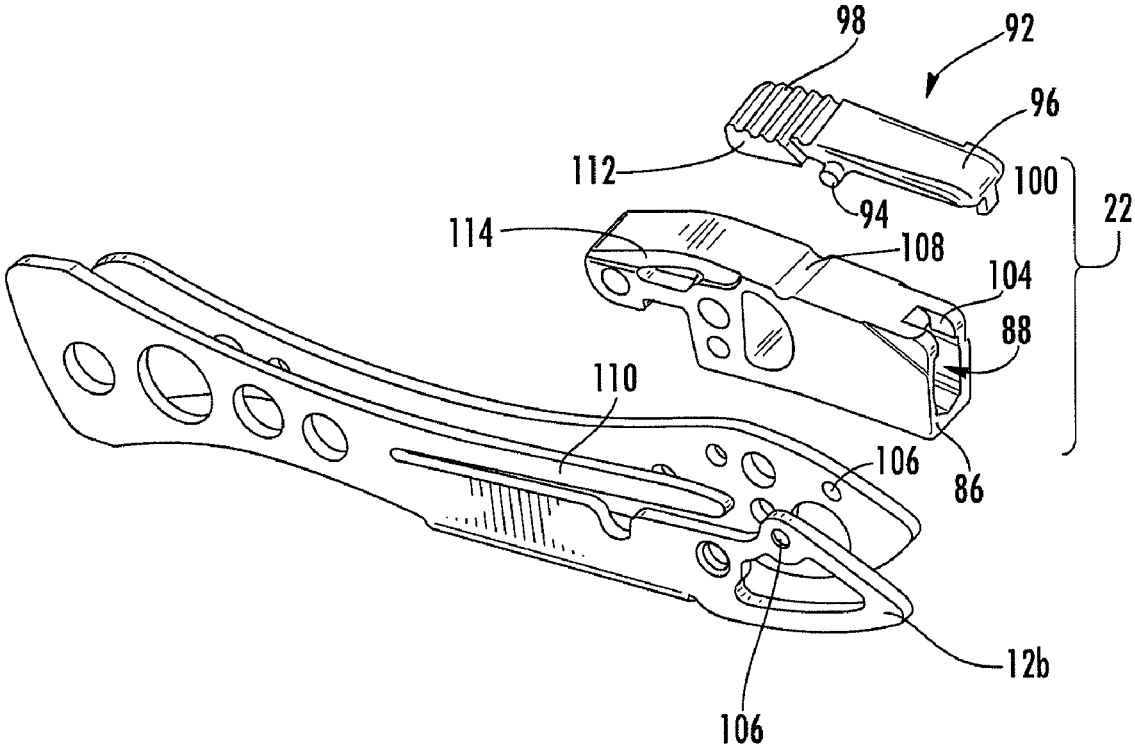
FIG. 8 is an exploded perspective view of the bit driver and the handle of FIG. 7.
Figure 9A:
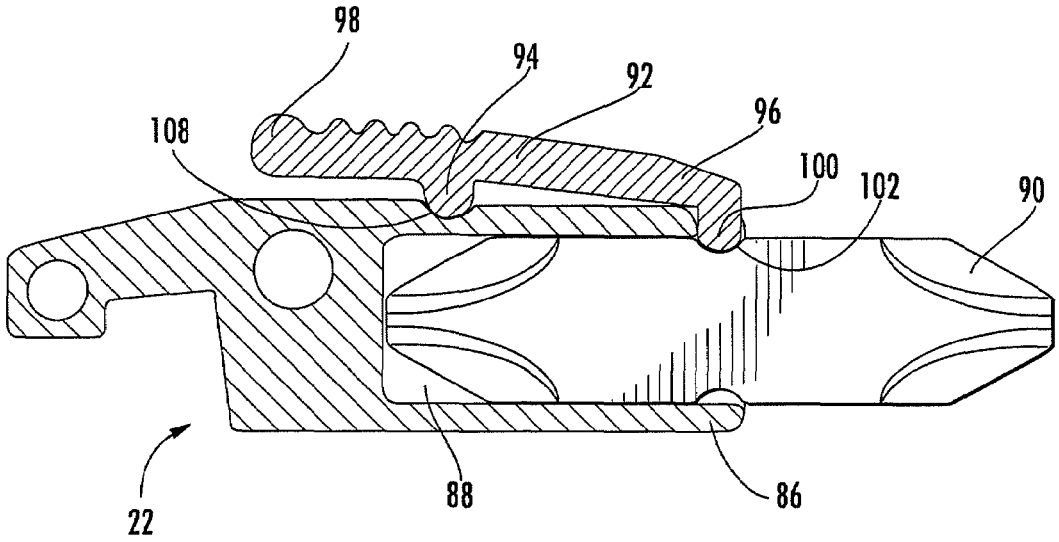
FIGS. 9A and 9B are side cross-sectional views of the bit driver of one embodiment of the present invention with the pivotable lock in a locked position and an unlocked position, respectively.
Figure 9B:
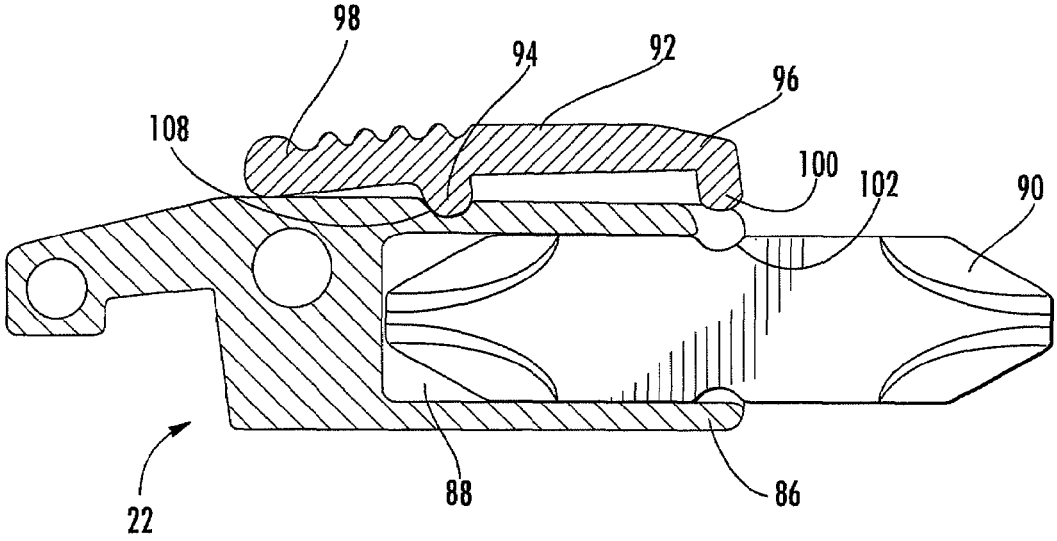
Figure 10:
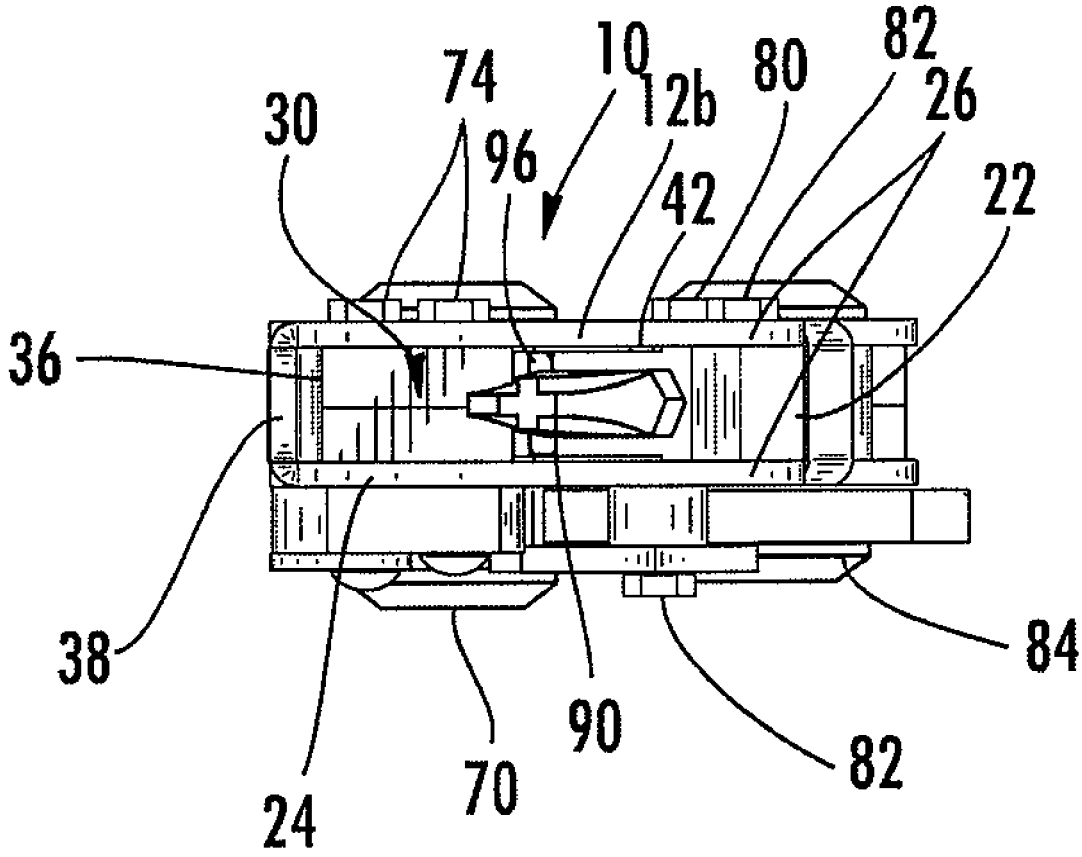
FIG. 10 is an end view of the multipurpose tool of FIG. 4 taken from the right side of FIG. 6.

While the pivotable lock 92 may be configured in various manners, the pivotable lock of one advantageous embodiment is depicted in FIGS. 7-9 and described hereinbelow. In this regard, the pivotable lock of the illustrated embodiment includes a pivot pin 94, an engagement member 96 for engaging the bit 90 and an actuation member 98. As shown, the engagement and actuation members may extend alongside the body 86 in opposite directions from the pivot pin. In one embodiment, the actuation member can include a ribbed, a knurled or other textured surface to facilitate engagement of the actuation member by a user.

Additionally, the engagement member 96 may include a tang 100 extending inwardly into the cavity 88 defined by the body 86 of the bit driver 22 for engaging the bit 90 and, in one embodiment, a groove 102 or other recess defined by the bit. While the tang can be configured in various manners, the tang of one embodiment is an inwardly extending tooth that has a width that is less than the width of the remainder of the engagement member and, in one embodiment, less than 50 percent of the width of the remainder of the engagement member. In order to receive the tang, the body of the bit driver of one embodiment includes a slot 104 opening into the cavity. By appropriately sizing the cavity and the slot relative to the bits that are to be engaged by the bit driver, the groove or other recess defined by the bit is exposed within the slot defined by the body of the bit driver such that the tang of the engagement member of the pivotable lock 92 can engage the groove or other recess defined by the bit and therefore engage the bit itself.

The pivot pin 94 may be integral with the engagement member 96 and the actuation member 98, but the pivot pin of one embodiment extends outwardly in opposite directions beyond the remainder of the pivotable lock 92 and beyond the body 86 of the bit driver 22. In this regard, the portion of the handle 12 that engages the bit driver can define corresponding apertures 106 for receiving end portions of the pivot pin such that the pivotable lock is capable of pivoting relative to the handle about a pivot axis defined by the pivot pin. The actuation member and the engagement member generally extend along one side of the pivot pin. By positioning the pivot pin proximate to a side surface of the body of the bit driver, the actuation and engagement members may be spaced slightly from the body of the bit driver by the pivot pin, thereby facilitating at least limited pivotal movement of the pivotable lock relative to the body of the bit driver. In order to appropriately position the pivotable lock relative to the body of the bit driver and to facilitate the pivotable movement of the pivotable lock, the side surface of the body of the bit driver can define a groove 108 for receiving the pivot pin.

In order to secure a bit 90 within the bit driver 22, the pivotable lock 92 is advantageously biased such that the engagement member 96 engages the bit in the absence of any countervailing force, such as a actuation force supplied by a user. In one embodiment, the pivotable lock is biased by a spring member 110 defined by the handle 12 that carries the bit driver. In the illustrated embodiment, the handle defines a cantilever spring extending lengthwise along the handle. A distal portion of the spring engages the actuation member in such a manner as to apply a force directing the actuation member 98 away from the body 86 of the bit driver and, correspondingly, directing the engagement member toward the body of the bit driver such that the engagement member engages the bit. In order to facilitate the engagement of the actuation member by the spring, the pivotable lock of one embodiment includes an actuation member having a contact portion 112 that extends laterally beyond other portions of the pivotable lock with the spring configured to engage the contact portion of the actuation member. Additionally, the body of the bit driver can define a recess 114 proximate the contact portion of the actuation member in order to receive at least a portion of the spring.

In use in instances in which the bit driver 22 does not include a bit 90, the spring 110 biases the pivotable lock 92 such that the engagement member 96 contacts the body 86 of the bit driver and extends into the cavity 88 defined by the body. In order to insert a bit, a user can depress the actuation member so as to overcome the force applied by the spring and to move the actuation member 98 toward the body of the bit driver. As such, the engagement member would move away from the body of the bit driver and facilitate the insertion of the bit therein. Alternatively, a user can simply push a bit into the cavity defined by the bit driver. If sufficient to overcome the bias force supplied by the spring 110, the force created by pushing the bit into the bit driver will cause the engagement member to deflect away from the body of the bit driver such that the bit can be inserted therein. In order to facilitate the insertion of the bit in this manner, the distal portion of the tang 100 of the engagement member can be rounded.

Once a bit 90 is inserted into the bit driver 22, any force that has been applied to the actuation member 98 can be removed such that the bias force supplied by the spring 110 again causes the engagement member 96 to be driven into contact with the bit, thereby securely engaging the bit within the bit driver such as by means of the engagement of the tang 100 with a groove 102 or other recess defined by the bit. Thereafter, the bit can be utilized without concern for the bit becoming dislodged from the bit driver. In order to remove the bit, such as following use or in order to insert a different type of bit, the user can depress the actuation member so as to again urge the actuation member toward the body 86 of the bit driver and correspondingly to move the engagement member away from the body of the bit driver, thereby disengaging the engagement member from the bit. The bit can then be removed and, if desired, another bit can be inserted into the bit driver.

The multipurpose tool 10 of one embodiment also includes a carabiner 24 for permitting the multipurpose tool to be removably secured to another object, such as a belt loop, key ring or the like. The carabiner is configured to move in concert with one of the handles 12 and is typically formed by the respective handle, such as at one end 12*b* thereof. As illustrated in FIGS. 1-3, the carabiner is typically formed, not by the handle that carries the bit driver, but by the opposite handle.

As shown in FIG. 1, the carabiner 24 includes first and second sidewalls 26 that are spaced from one another. As will be described hereinafter, the first and second sidewalls also generally define a portion of the handle 12, such as a frame, so as to permit the handle including an integral carabiner to be fabricated in an efficient manner. Thus, the carabiner moves in concert with the handle and is generally not movable relative to the remainder of the handle, i.e., is incapable of movement independent of the remainder of the handle. As shown, the first and second sidewalls are spaced apart from one another such that at least portions of the first and second sidewalls define an externally accessible gap 30 therebetween. As described below, the spacing of the first and second sidewalls and, therefore, the size of the gap therebetween is selected so as to receive, either entirely or at least partially, the tool carried by the other handle, such as the bit driver 22 in the illustrated embodiment.

The carabiner 24 defines an opening 32 into an engagement aperture 34 with the engagement aperture being accessible through both the first and second sidewalls 26. In this regard, the object to which the multipurpose tool 10 is desirably attached may be inserted through the opening into the engagement aperture such that the carabiner is effectively clipped to the object. In order to secure the object within the engagement aperture, the carabiner can also include a gate 36 that extends across the opening defined by the carabiner. While the carabiner can include a variety of gates, the carabiner of one embodiment includes a gate that is pivotally connected, at one end, to the handle 12. In this regard, the gate may be spring loaded so as to close the opening in the absence of any applied force. Although the gate can be pivotally connected to the handle in various manners, the gate of the illustrated embodiment is a rectangular hoop that is pivotally connected to one end 18*b* of the spring members 18 of the handle, namely, the ends of the spring members opposite the camming mechanism. Alternatively, the gate could be pivotally connected to the frame of the handle or to other components of the handle if so desired.

Although the first and second sidewalls 26 are spaced from one another, one or more portions of the first and second sidewalls may be interconnected. For example, portions of the first and second sidewalls proximate the opening 32 defined by the carabiner 24 may be interconnected as indicated by interconnect 38. As discussed hereinbelow in conjunction with an embodiment in which the first and second sidewalls also form the frame of the handle 12, medial portions of the first and second sidewalls may also be interconnected with interconnect 40, albeit at some distance spaced apart from the carabiner. However, other portions of the first and second sidewalls are free of any direct connection, as also discussed below.

While the carabiner 24 may have various orientations relative to the respective handle 12 and, in turn, relative to the multipurpose tool 10, the carabiner of one embodiment is configured such that the opening 32 defined by the carabiner faces inwardly, i.e., faces toward the other handle, in instances in which the multipurpose tool is in the open position as shown in FIGS. 1-3. As such, the transition of the multipurpose tool from the open position to a closed position as shown in FIGS. 4-6 repositions the carabiner such that the opening defined by the carabiner now faces outwardly, i.e., faces away from the other handle, so as to be more easily accessed by the user.

In order to reduce the form factor of the multipurpose tool 10 in the closed position, the carabiner 24 is configured such that a tool carried by the other handle 12, that is, the handle not carrying the carabiner, is at least partially disposed within the carabiner between the first and second sidewalls 26 when the handles are in the closed position. As shown in FIGS. 4-7, for example, the bit driver 22 is at least partially disposed within the carabiner between the first and second sidewalls when the multipurpose tool is in the closed position. As such, the resulting configuration of the multipurpose tool is more compact than if the bit driver did not fold at least partially within the carabiner.

In order to receive the tool, such as the bit driver 22, the carabiner 24 is therefore advantageously configured such that the first and second sidewalls 26 are spaced apart by a distance sufficient to receive the tool, either entirely or partially. Additionally, while portions of the first and second sidewalls may be interconnected, such as by interconnects 38 and 40 discussed above, those portions of the first and second sidewalls that define the gap 30 into which the tool is to be folded are not directly connected and, instead, define an externally accessible gap therebetween. In the embodiment depicted in FIGS. 4-6 and 10, for example, the gap into which the tool is folded is defined by those portions of the first and second sidewalls that are positioned on the opposite side of the carabiner from the opening 32 defined by the carabiner. Thus, those portions of the first and second sidewalls that are positioned on the opposite side of the carabiner from its opening are advantageously free of any direct connection that would otherwise restrict the insertion of the tool carried by the other handle into the gap defined by the carabiner.

The carabiner 24 and the tool that folds at least partially within the carabiner can cooperate such that the tool is frictionally engaged by the carabiner when the handles 12 are in the closed position, thereby reducing the likelihood that the multipurpose tool 10 will be inadvertently opened. In one embodiment, for example, the tool or the handle carrying the tool can define a projection 42 that extends outwardly therefrom. The carabiner may define a corresponding recess, such as a corresponding opening 44, for receiving and engaging the projection when the handles are in the closed position. To facilitate the tool's insertion into and withdrawal from the carabiner, the projection is generally sized to make contact with a respective sidewall 26 of the carabiner as the handles are being transitioned to and from the closed position. However, the projection is generally sized to extend only slightly beyond the gap 30 nominally defined by the first and second sidewalls of the carabiner. As such, the respective sidewall can deflect the relatively small amount that is required to permit the tool including the projection to be inserted or withdrawn from the carabiner. In order to facilitate the insertion of or withdrawal of the tool from the carabiner, the projection may have the hemispherical or otherwise rounded end portion. In one embodiment, the tool or the handle carrying the tool may include a pair of projections extending outwardly from opposite sides and the carabiner may accordingly defined respective recesses, such as respective openings, in both the first and second sidewalls for receiving and engaging the respective projections.

In one embodiment, the carabiner 24 may also include an integral bottle opener. As shown, the carabiner may include an inwardly turned lip 25 proximate the opening 32 defined by the carabiner. For example, the lip may be a portion of or proximate to interconnect 38. In order to open a bottle, the bottle cap may be inserted through the opening, thereby displacing the gate 36, such that the lip engages the bottle cap and permits the transfer of force thereto by the user.

Figure 11:
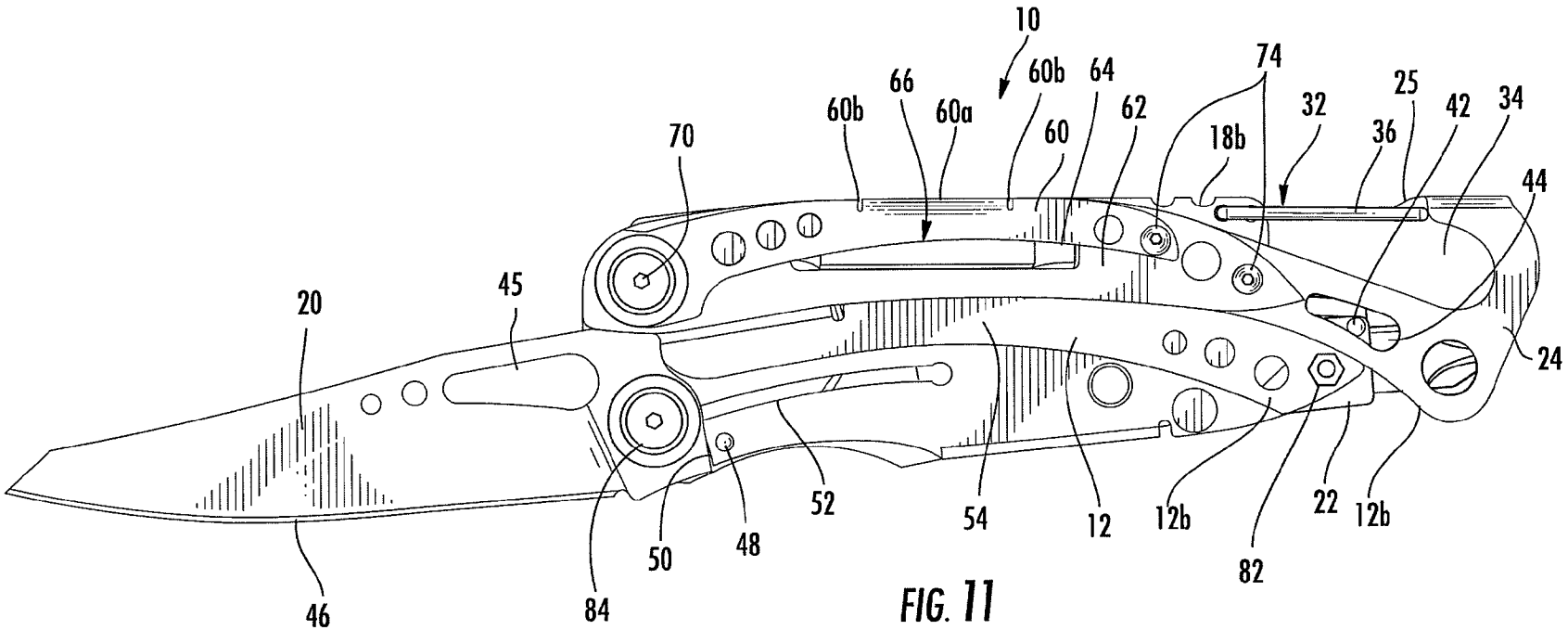
FIG. 11 is a view of the first side of the multipurpose tool of FIG. 4 with the knife blade deployed.

As shown in FIG. 11, the multipurpose tool 10 of the illustrated embodiment can include a knife blade 20 that can be extended, particularly when the multipurpose tool is in the closed position. As shown, the knife blade is configured to pivotally rotate relative to the handle 12 that carries the knife blade. In order to facilitate the rotation of the knife blade from its stowed position, the knife blade can define an opening 45, typically opposite the cutting edge 46, that a user can grasp in order to rotate the knife blade outwardly away from the handle. In order to bias the knife blade to remain in the fully opened position, the multipurpose tool and, in particular, the frame of the handle that carries the knife blade can include a liner lock 48 that engages the rear portion 50 of the knife blade once the knife blade is in the fully opened position. In the illustrated embodiment, the liner lock is carried by a portion of the frame that is partially separated from the remainder of the frame by a slit 52 such that the liner lock is adapted to the flex slightly. As such, the bias provided by the liner lock that serves to maintain the knife blade in the fully opened position can be overcome by the application of a force to the liner lock by the user that causes the liner lock to flex slightly in a direction away from the knife blade and be disengaged from the knife blade. Although not shown, the handle that carries the knife blade can include a projection that engages the leading and/or a medial portion of the knife blade in instances in which the knife blade is folded into the handle in order to reduce the likelihood of inadvertent opening of the knife blade by requiring the application of additional force by the user to overcome the resistance provided by the projection. In order to prevent access to the cutting edge of the knife blade while the knife blade is in a folded position, the handle that carries the knife blade can also include a guard 54 attached or otherwise integral to the frame of the respective handle such that the guard covers the cutting edge of the knife blade while the knife blade is in a folded position.

Figure 12:
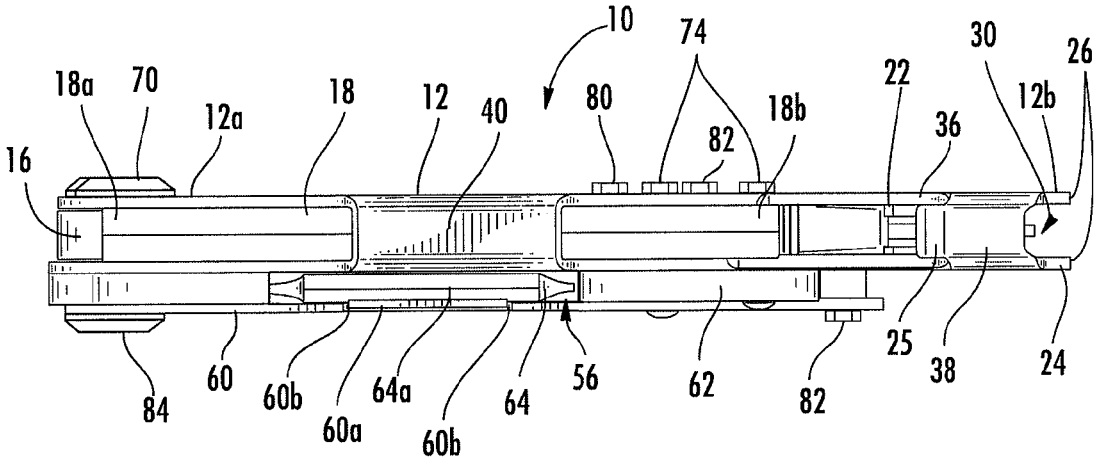
FIG. 12 is a side view of the multipurpose tool of FIG. 4 depicting a bit stored in a pocket defined by one handle taken from the upper side of FIG. 6 and looking downwardly into the multipurpose tool.

As noted above, the multipurpose tool 10 can include a bit driver 22 for engaging corresponding bits, such as screwdriver bits, torx bits, hex bits, Robertson bits, etc. Accordingly, the multipurpose tool of one embodiment is configured to store at least one bit in instances in which the bit is not engaged by the bit driver. As such, extra bits, i.e., bits that are not currently engaged by the bit driver, can be stored by the multipurpose tool itself in order to avoid misplacement of the extra bits. As shown in FIGS. 4 and 12, for example, one of the handles 12 of the multipurpose tool, such as the handle that carries the carabiner 24 in the illustrated embodiment, defines a pocket 56 opening through a medial portion of the respective handle. In this regard, the pocket opens through a portion of the handle spaced apart from either end 12*a*, 12*b* of the handle. In the illustrated embodiment, the pocket defined by the handle opens in such a manner such that the pocket is accessible or exposed when the multipurpose tool is in the closed position. In other words, the pocket defined by the handle faces outwardly, that is, faces away from the other handle, when the multipurpose tool is in the closed configuration. However, other embodiments of the multipurpose tool may include a handle that defines a pocket that opens in other directions, if so desired.

Although the pocket 56 can be formed by the handle 12 in various manners, the handle of one embodiment includes a frame and a spring element 60 operably connected to the frame, such as to one of the first and second sidewalls 26, with the pocket being defined between the spring element and the frame. For example, the frame may define one side surface of the pocket, while the spring element defines the opposed side surface of the pocket. The handle of this embodiment may also include a spacer 62 positioned between the spring element and the frame which defines the remainder of the pocket, such as the opposed end surfaces and the inwardmost surface of the pocket. As described below, the frame, the spacer and the spring member may be connected in various manners, such as by one or more fasteners.

As its name suggests, the spring element 60 is generally a relatively thin plate and is configured to flex or deflect a sufficient amount to permit insertion and withdrawal of the bit 64. While the spring element may be formed of various materials and may, accordingly, have various dimensions, the spring element of one embodiment is formed of hardened stainless steel and has a thickness of 0.010 inches to 0.050 inches and, more particularly, a thickness of about 0.030 inches. In other embodiments, however, the spring element is formed of other metals or plastic materials. Likewise, the other components of the multipurpose tool 10 may be formed of stainless steel or other metallic or plastic materials.

The pocket 56 and the bit 64 may be sized such that the bit fits snugly within the pocket and is frictionally secured therein. For example, the handle 12 may define the pocket to have the shape of a rectangular solid and the shank portion 64*a* of the bit can have a corresponding polygonal shape with opposed major surfaces that frictionally engage the side surfaces of the pocket formed by the spring element 60 and the frame. As shown, the functional tips of the bit can extend from one or both ends of the polygonally shaped shank portion.

The spring element 60 may include additional features to facilitate the competing objectives of flexibility and secure retention of the bit 64. In this regard, a medial portion 60*a* of the spring member that corresponds positionally to the polygonally shaped shank portion 64*a* of the bit may be partially separated from the remainder of the spring element, such as by a pair of slits 60*b*. The medial portion of the spring member may then be bent inward slightly relative to the pocket 56 so as to ensure secure retention of the bit while concurrently being capable of flexing sufficiently to permit insertion and withdrawal of the bit to and from the pocket.

The handle 12 can also define a recess 66 opening into the pocket 56. This recess is generally smaller than the bit 64 such that the bit cannot be inserted or withdrawn through the recess. However, the recess permits a user to touch the bit and to push the bit at least partially out of the pocket. The bit may then be grasped by the user and fully removed from the pocket. As such, the recess is generally positioned such that that portion of the bit that is inserted the furthest, i.e., deepest, into the pocket is exposed. In one embodiment, the recess is defined by a combination of a spring element 60 and the spacer 62 with the spring element only covering a portion of the pocket defined by the spacer and, in particular, only covering that portion of the pocket defined by the spacer that is proximate the opening through which the bit is inserted into and withdrawn from the pocket.

By securely retaining an extra bit 64 within the pocket 56 defined by the handle 12, the extra bit is carried with the multipurpose tool 10 and is readily available to a user if needed. While the multipurpose tool of the illustrated embodiment includes a pocket sized to store a single bit, the handle can define the pocket so as to be larger in order to removably store two or more bits. By disposing the extra bits within a medial portion of the handle, the bits can be advantageously stored without altering the functionality of the multipurpose tool or increasing the size of the multipurpose tool.

Figure 13:
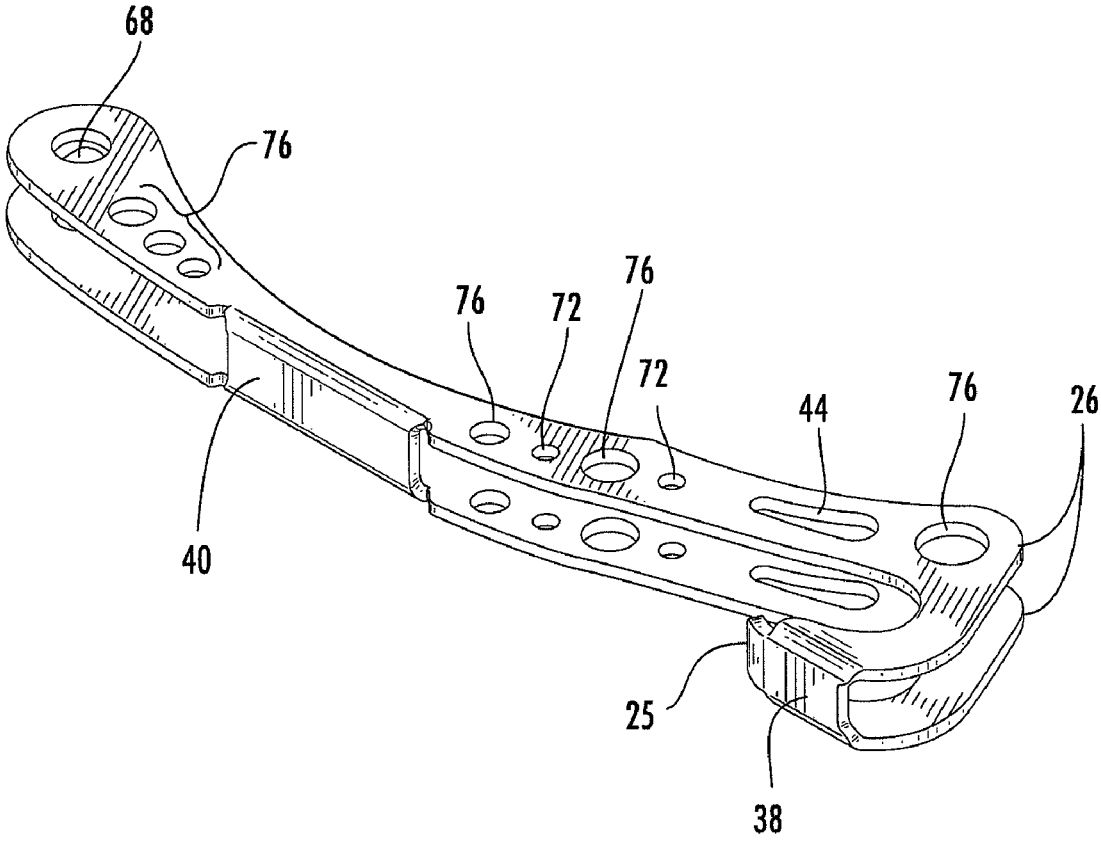
FIG. 13 is perspective view of a frame according to one embodiment of the present invention.

As described above, the handle 12 of one embodiment includes a frame having an integral carabiner 24. As described, the frame of this embodiment includes first and second sidewalls 26 that are operably connected to and spaced apart from one another in such a manner as to form the form the carabiner. While the frame may have various configurations, the frame of one embodiment is depicted in FIG. 13. As shown, the first and second sidewalls are spaced apart from one another and are interconnected by interconnect 38 proximate the opening 32 defined by the carabiner and by interconnect 40 in a medial portion of the frame. As described above, the first and second sidewalls can also define one or more openings, such as opening 44 for receiving corresponding projections 42 of the tool or the handle carrying the tool so as to releasably secure the handles in the closed position. Additionally, the first and second sidewalls can define an opening 68 proximate the end 12*a* of the handle opposite the carabiner for receiving a fastener 70 that secures the handle to a respective jaw and defines the axis about which the handle pivots with respect to the respective jaw.

Figure 14:
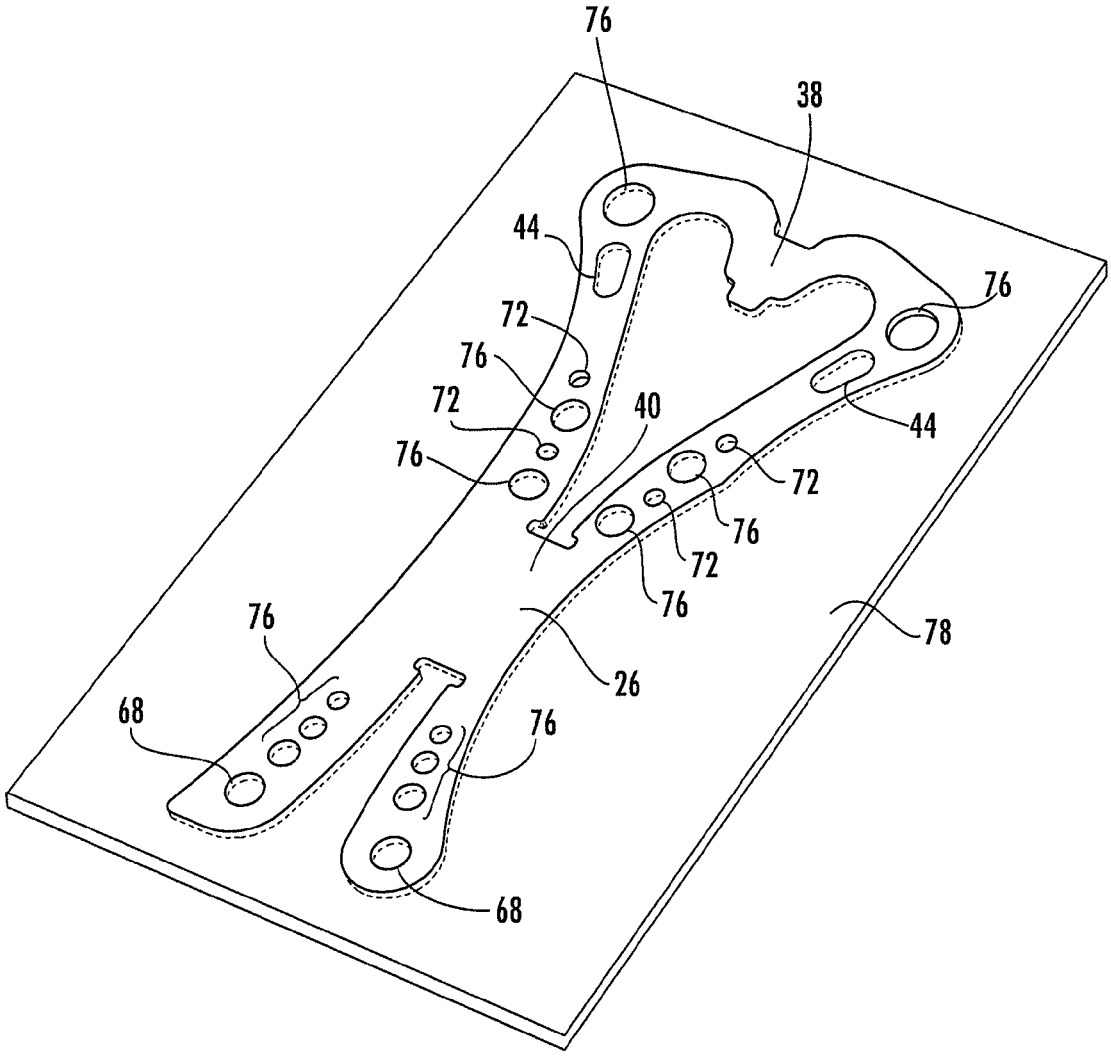
FIG. 14 is a perspective view illustrating the stamping of the frame of FIG. 13 from a workpiece in accordance with one embodiment of the present invention.

The first and second sidewalls 26 of the frame can also define one or more openings 72 for receiving fasteners 74 for securing the frame to one or more spring members 18 and, more typically, to the end 18*b* of the spring members opposite the camming mechanism. As shown in FIGS. 13 and 14, the first and second sidewalls can optionally define additional openings 76 to reduce the resulting weight of the frame and, in turn, the multipurpose tool 10 as well as to correspondingly reduce the material requirement.

In order to construct one embodiment of the handle 12 that carries the carabiner 24, one or more spring members 18 may be positioned between the first and second sidewalls 26 of the frame. In this regard, the spring members may be positioned such that openings defined by the end 18*b* of the spring members opposite the camming mechanism are aligned with corresponding openings 72 defined by the frame. The spring members may then be secured to the frame by means of fasteners 74 that extend through the aligned openings. The other end 18*a* of the spring members has no direct connection to the frame so as to permit deflection of the spring members as the spring members contact and ride upon the cams of the jaws. As described above, the end 18*b* of the spring members that is connected to the frame may also carry the gate 36 that extends across the opening 32 defined by the carabiner.

In the embodiment in which the multipurpose tool 10 defines a pocket 56 for storing extra bits 64, the spacer 62 and the spring element 60 may also be attached to one of the first or second sidewall 26, such as an exterior facing surface of the one of the sidewalls as shown in FIGS. 2, 5, 11 and 12. For example, the spacer and the spring element can define respective openings that are aligned at one end with corresponding openings 72 defined by the frame and at the other end with opening 68 that is also defined by the frame. As such, the spacer and the spring element can be secured to the frame with the fasteners 74 that were described above to extend through openings 72. Finally, the handle including the frame, spring members 18, spacer and spring element may be attached to the respective jaw via a fastener 70 that extends through the openings aligned with frame openings 68 and establishes an axis about which the handle pivots with respect to the jaw. Although not illustrated, the multipurpose tool may also include a belt clip that can be secured to the handle with fastener 70, if desired.

In embodiments in which the carabiner 24 is integral with the remainder of the frame, the frame including the carabiner can be fabricated in an efficient manner. In this regard, the frame may be stamped, such as by fine blanking, from a workpiece 78 as shown in FIG. 14. The frame that is stamped from the workpiece includes first and second interconnected frame portions. The frame is then removed from the remainder of the workpiece and bent so as to align the first and second interconnected frame portions to thereby define corresponding first and second sidewalls 26 that are spaced apart from one another as shown in FIG. 13. While the frame may be bent in various fashions, the frame may be bent about a form, if desired. In the process of stamping the workpiece and bending the frame, the carabiner is formed and is defined by portions of the first and second sidewalls as described above. As such, the frame can be fabricated in an efficient manner and can include not only the structural features of the frame, but also the carabiner proximate one end thereof.

The other handle 12 of the multipurpose tool 10 of the illustrated embodiment may be constructed in an analogous manner. In this regard, the handle can include a frame, such as a frame formed by stamping and bending as described above, that includes first and second sidewalls 26 that are spaced apart from one another as well as the guard 54 that covers the cutting edge 46 of the knife blade 20 in instances in which the knife blade is in the folded position. Although spaced apart, the first and second sidewalls and the guard are also interconnected to one another to define an integral structure. One or more spring members 18 may be disposed between the first and second sidewalls and secured thereto, such as with one or more fasteners 80 positioned proximate one end 18*b* of the spring members. Additionally, the bit driver 22 may be positioned between the first and second sidewalls proximate one end thereof and secured to the frame by one or more fasteners 82, as described above in conjunction with FIGS. 7 and 8. An assembly consisting of the frame, the spring members, the bit driver and the knife blade is then pivotally connected to the respective jaw by means of a fastener 84 that extends through aligned openings defined by the frame and the knife blade to define the axis about which the handle will rotate relative to the respective jaw.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tool comprising:

a handle;

a cantilever spring extending in a lengthwise direction along the handle; and a bit driver carried by the handle, the bit driver comprising:

a body defining a cavity for receiving at least a portion of a bit; and a pivotable lock configured to be directly engaged by a user and to move between a locked position in which the lock engages the bit and an unlocked position in which the lock is spaced and thereby disengaged from the bit, wherein one portion of the pivotable lock overlies the body and a second portion of the pivotable lock extends in a lateral direction beyond a first surface of the body, and wherein the cantilever spring engages the second portion of the pivotable lock that extends in the lateral direction beyond the first surface of the body.

2. A tool according to claim 1 wherein the spring member is configured for biasing the pivotable lock toward the locked position.

3. A tool according to claim 1 wherein the body defines a lengthwise extending recess opening through both end and side surfaces of the body for receiving at least a portion of the spring through the opening in the end surface, and wherein the opening of the recess through the side surface of the body is positioned relative to the pivotable lock such that the spring engages the pivotable lock therethrough.

4. A tool according to claim 1 wherein the pivotable lock comprises:

a pivot pin;

an engagement member for engaging the bit; and an actuation member, wherein the engagement and actuation members extend along the body in opposite directions from the pivot pin.

5. A tool according to claim 4 wherein the engagement member comprises a tang for engaging the bit in the locked position.

6. A tool according to claim 4 wherein the pivot pin extends outwardly in opposite directions beyond the body.

7. A tool according to claim 6 wherein the pivot pin is engaged by the handle to permit the pivotable lock to pivot relative to the handle.

8. A tool according to claim 4 wherein the body defines a groove for receiving the pivot pin.

9. A tool according to claim 1 wherein the pivotable lock comprises an engagement member for engaging the bit and an actuation member configured to be engaged by a user, and wherein at least a portion of the actuation member extends further in the lateral direction than the engagement member so as to be engaged by the cantilever spring.

10. A tool according to claim 1 wherein the body defines a recess at least partially in alignment with the second portion of the pivotable lock that extends in the lateral direction beyond the first surface of the body for receiving at least a portion of the cantilever spring.

11. A bit driver comprising:

a body defining a cavity for receiving at least a portion of a bit; and a pivotable lock disposed exterior of and proximate a first surface of the body and configured to move between a locked position in which the lock engages the bit and an unlocked position in which the lock is spaced and thereby disengaged from the bit, wherein the pivotable lock comprises:

an engagement member for engaging the bit; and an actuation member configured to be directly engaged by a user, wherein the engagement and actuation members extend along the body in opposite lengthwise directions from a pivot pin, and wherein one portion of the pivotable lock overlies the body and a second portion of the pivotable lock extends in a lateral direction beyond the first surface of the body and is configured to be engaged by a spring member at a location laterally beyond the first surface of the body.

12. A bit driver according to claim 11 wherein the engagement member comprises a tang for engaging the bit in the locked position.

13. A bit driver according to claim 11 wherein the pivotable lock further comprises a pivot pin that extends outwardly in opposite directions beyond the body.

14. A bit driver according to claim 11 wherein the body defines a groove for receiving the pivot pin.

15. A bit driver according to claim 11 wherein the body defines a lengthwise extending recess opening through both end and side surfaces of the body for receiving at least a portion of the spring member through the opening in the end surface, and wherein the opening of the recess through the side surface of the body is positioned relative to the pivotable lock such that the actuation member is configured to be engaged by the spring member through the opening in the side surface of the body.

16. A tool according to claim 11 wherein at least a portion of the actuation member extends further in the lateral direction than the engagement member so as to be engaged by the spring member.

17. A tool according to claim 11 wherein the body defines a recess at least partially in alignment with the second portion of the pivotable lock that extends in the lateral direction beyond the first surface of the body and that is configured to receive at least a portion of the cantilever spring.

18. A bit driver comprising:

a body defining a cavity for receiving at least a portion of a bit, wherein the body also defines a lengthwise extending recess opening through both end and side surfaces of the body and configured to receive a portion of a spring member through the opening in the end surface; and a pivotable lock disposed exterior of the body, the pivotable lock comprising:

a pivot pin extending in a lateral direction;

an engagement member for engaging the bit; and an actuation member configured to be engaged by both a user and the spring member through the opening in the side surface of the body, wherein the engagement and actuation members extend along the body in opposite lengthwise directions from the pivot pin.

19. A bit driver according to claim 18 wherein the pivotable lock is configured to move between a locked position in which the lock engages the bit and an unlocked position in which the lock is spaced and thereby disengaged from the bit.

20. A bit driver according to claim 19 wherein the engagement member comprises a tang for engaging the bit in the locked position.

21. A bit driver according to claim 18 wherein the pivot pin extends outwardly in opposite directions beyond the body.

22. A tool according to claim 18 wherein at least a portion of the pivotable lock extends in a lateral direction beyond the body so as to be engaged by the spring member.

* * * * *